United States Patent [19]

Kent

[11] Patent Number: 4,511,094

[45] Date of Patent: Apr. 16, 1985

[54] WINDING APPARATUS

[75] Inventor: Henry R. Kent, San Diego, Calif.

[73] Assignee: Maxwell Laboratories, Inc., San Diego, Calif.

[21] Appl. No.: 443,292

[22] Filed: Nov. 22, 1982

[51] Int. Cl.[3] ..... H01F 41/08; H01F 41/12

[52] U.S. Cl. ..... 242/7.08; 242/7.11; 242/7.13; 242/53; 242/56.1

[58] Field of Search ..... 242/1.1 A, 2, 3, 7.11, 242/7.08, 7.13, 7.14, 7.05 R, 53, 56.1, 4 A; 29/605; 57/10; 156/443, 425, 428, 189

[56] References Cited

U.S. PATENT DOCUMENTS

| | | | |
|---|---|---|---|
| 2,541,302 | 2/1951 | Slangal | 57/10 |
| 2,641,084 | 6/1953 | Estes | 57/10 |
| 2,738,136 | 3/1956 | Bugg | 242/1.1 A |
| 2,858,992 | 11/1958 | Wentz | 242/7 |
| 2,912,177 | 11/1959 | Oram et al. | 242/9 |
| 3,049,230 | 8/1962 | Scoy | 242/53 |
| 3,078,053 | 2/1963 | Duenke | 242/7.13 |
| 3,156,422 | 11/1964 | Zepernick | 242/9 |
| 3,215,102 | 11/1965 | Overall | 112/64 |
| 3,255,976 | 6/1966 | Mede | 242/7 |
| 3,291,403 | 12/1966 | Montgomery | 242/7 |
| 3,333,778 | 8/1967 | Levenetz et al. | 242/3 |
| 3,391,873 | 7/1968 | Hardesty | 242/2 |
| 3,411,727 | 11/1968 | Uhlig et al. | 242/2 |

*Primary Examiner*—Billy S. Taylor

*Attorney, Agent, or Firm*—Fitch, Even, Tabin & Flannery

[57] ABSTRACT

A winding machine for manufacturing transformer cores includes a ribbon-dispensing assembly which travels in a predetermined path about a stationary mandrel to deposit successive layers of ribbon upon the mandrel under controlled tension while applying transverse pressure to the peripheral surface of the winding to press air from between the layers. In the preferred embodiment, a counterbalanced rotating track engages the ribbon-dispensing assembly as it travels around the mandrel. The ribbon dispensing assembly is preferably transported by a chain drive.

4 Claims, 5 Drawing Figures

28
128
42
48
46
150
5.
5.
103
32
22
68
78
72
186
56
58
74
76
64
16
14
44
50
52
60
62
12
112
18
124
34
20
38
10
104b
40
30
104a
126
114
24
144
146
188
145
172
184
146
182
180
174
178
4.
4.
26
11
130
158
156
168
151
152
160
170

28
128
46
11
150
136
132
138
100
88
136
134
136
90
96
20
22
186
194
108
92
192
196
110
98
190
124
126
112
10
143
104b
104a
142
130
140
114
149

WINDING APPARATUS

BACKGROUND OF THE INVENTION

The present invention relates generally to winding apparatus, and more particularly to a novel winding apparatus for manufacturing wound cores of the type employed in electric transformers and the like.

Recent developments in transformer technology have created the need for irregular shaped transformer cores made of layers of ribbon wound directly atop one another about irregularly shaped mandrels of various sizes. One type of transformer core used in magnetic switching and pulse compression apparatus is made of layers of conductive magnetic ribbon wound in the shape of an elongated loop with straight parallel sides and semicircular ends. In some of these transformer cores, insulating ribbon is interleaved with the conductive ribbon as the core is wound. One type of conductive ribbon used in such cores is METGLASS, a non-crystalline, tension-sensitive magnetic ribbon developed by Allied Industries. The tension-sensitive nature of the ribbon can make winding difficult because application of longitudinal tension during winding in excess of a certain limit may detrimentally alter the magnetic properties which are essential to the function of the ribbon.

In manufacturing wound cores it is desirable that the successive layers be aligned directly over one another and be tightly packed so as to prevent relative movement between the layers and maintain their alignment. When winding a core having planar outer surfaces formed by generally planar surfaces on the mandrel, obtaining desired tightness between successive layers along the planar portions of the mandrel is difficult due to the tendency of air to accumulate between successive layers of the winding. This problem is not encountered at the outwardly curved portions of the mandrel because the tension on the ribbon as it is applied urges it against the curved underlying surface in a manner to progressively force the air from between the wound layers and thereby enable tight packing of the ribbon. However, along generally planar surface portions of the mandrel, the ribbon tension does not urge the ribbon against the underlying surface in the same manner, and air may be captured between successive layers of ribbon so as to cause the winding to bulge outwardly. Increasing the tension on the ribbon may reduce the bulging somewhat, but the tension-sensitive nature of the ribbon limits the tension which may be applied to accomplish this. Known winding machines have not been capable of satisfactorily manufacturing irregular shaped windings of the aforementioned type due to their inability to maintain the windings tightly packed.

SUMMARY OF THE INVENTION

In accordance with the present invention, a winding machine is provided for wrapping successive layers of ribbon under controlled tension upon a mandrel with transverse pressure applied against the peripheral surface of each layer as it is deposited so as to substantially eliminate air from between successive layers and produce a tightly packed winding. The winding machine is suitable for use in producing windings of various shapes and dimensions, and is particularly well-suited for producing windings with planar or approximately planar portions on their peripheral surfaces. The mandrel is fixed to a frame and preferably is positioned so that generally planar portions of the windings formed thereon will be oriented vertically to avoid sagging due to gravity. In the preferred embodiment, ribbon is wrapped about the mandrel in successive layers by a ribbon dispensing assembly which is carried in a predetermined path around the mandrel by a motor-driven chain. A counterbalanced rotating track slidably engages the ribbon dispensing assembly to reduce variations in loading of the drive motor during each winding cycle and to guide the assembly in a manner to increase the precision with which each cycle is repeated. The ribbon dispensing assembly is maintained in predetermined relation to the mandrel as it transverses the planar portions of its guide path by elongated guide channels fixed to the frame and cooperative with cam followers mounted on the dispensing assembly. The ribbon dispensing assembly carries two spools of ribbon on a carrier plate, and includes a pressure roller mounted on a biasing arm to press each successive layer onto the underlying winding so as to force air from between the successive layers. Drag mechanisms on each of the spools regulate tension on the ribbons as they are pulled from the spools.

Accordingly, it is a general object of the present invention to provide a novel winding machine for depositing ribbon upon a mandrel to produce a tightly packed winding.

Another object of the present invention is to provide novel apparatus for producing tightly wound transformer cores having elongated generally planar peripheral surface portions.

A more particular object of the present invention is to provide a novel core winding machine which is operative to deposit successive layers of ribbon on a mandrel and produce a tightly wound winding by applying transverse pressure to each layer as it is applied.

Further objects and advantages of the present invention will become apparent from the following description of the invention when taken in conjunction with the accompanying drawings.

DETAILED DESCRIPTION OF THE PREFERRED EMBODIMENT

Figure 1:
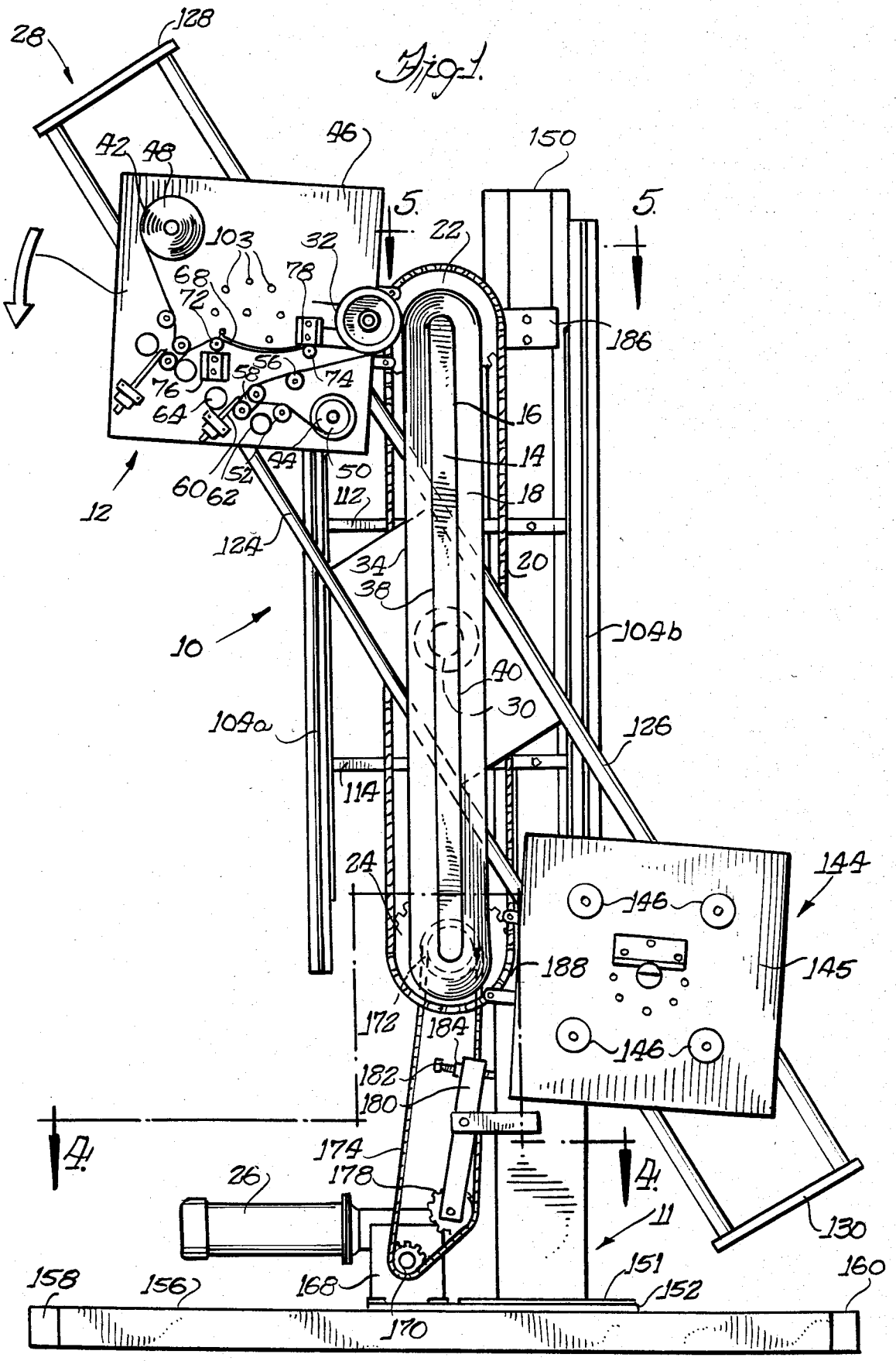
FIG. 1 is a front elevational view of a winding machine embodying the present invention.

Referring now to the drawings and in particular to FIG. 1, a winding machine constructed in accordance with a preferred embodiment of the present invention is indicated generally at 10. Very generally, the winding machine 10 includes a frame 11 fixedly supporting an elongated mandrel 14 upon which successive layers of conductive magnetic ribbon and insulating ribbon are wound. A ribbon dispensing assembly, indicated generally at 12, travels in a predetermined path about the mandrel 14, and deposits successive layers of ribbon upon a peripheral surface 16 of the mandrel so as to form a built-up winding 18. The ribbon dispensing assembly 12 is carried through its path by a roller chain 20 which is mounted on upper and lower sprockets 22 and 24 and driven by a suitable electric motor 26. A counterbalanced track 28 rotates about a horizontal support 30 and slidably engages the ribbon dispensing assembly 12 so as to guide it and balance the load on the motor as will be described in greater detail below. A pressure roller 32 mounted on the ribbon dispensing assembly is urged toward the peripheral surface 34 of the winding to progressively press each successive layer onto the underlying layer and eliminate air from between successive wound layers.

Turning now to a more detailed description of the illustrated embodiment, the ribbon dispensing assembly 12 travels in an elongated loop-shaped or "race track" shaped path about the fixed mandrel 14. The mandrel is fastened to the forward end of the horizontal support 30 and is supported thereby. Referring to the position of the ribbon dispensing assembly illustrated in FIG. 1 as a starting position, the assembly travels vertically downward, parallel to a generally straight left side 38 of the mandrel then traverses a semicircular arc around the lower sprocket 24 and proceeds vertically upward parallel to a generally straight right side 40 of the mandrel after which it traverses a semicircular arc over the upper sprocket 22 to return to the starting position.

As the ribbon dispensing assembly 12 travels about the mandrel, conductive magnetic ribbon and insulating ribbon are pulled from first and second supply spools 42 and 44 respectively, and are pressed against the mandrel and each successive layer of the winding 18 by the pressure roller 32. The supply spools are rotatably mounted on a vertical carrier plate 46. The pressure roller 32 is rotatably mounted on the upper end of an arm 47 (FIG. 2) which is pivotally mounted at its lower end on the back side of the carrier plate 46. A spring (47*a*) or other suitable means is employed to bias the arm 47 toward the mandrel in a manner to press the pressure roller against the peripheral surface of the winding.

To regulate tension on the ribbon as it is pulled from the spools, independently adjustable drag mechanisms (not shown) frictionally engage each of the ribbon supply spools 42 and 44 to apply a predetermined braking torque to each. When a tension-sensitive ribbon is being dispensed from a spool, the drag mechanism for that spool may be adjusted to apply a relatively low torque to ensure that a critical maximum tension is not exceeded. Increasing the drag on the spools increases the tension on the ribbon which tends to provide a tighter winding.

In the illustrated embodiment, the first supply spool 42 carries tension-sensitive conductive magnetic ribbon 48, and the second spool 44 carries insulating ribbon 50. Each ribbon is threaded past rotating cylindrical guides which extend horizontally from the front of the vertical carrier plate 46. The path of the insulating ribbon 50 is defined by three guides 52, 54 and 56. The first and third guides 52 and 56 are mounted directly on the carrier plate. The second guide 54 is mounted on a short pivot arm 58 which is biased by a spring 60 to provide slack take-up and maintain generally constant longitudinal tension in the insulating ribbon. Stops 62 and 64 limit the range of motion of the arm 58. A similar slack take-up mechanism is provided for the magnetic ribbon 48.

To maintain the magnetic ribbon 48 properly aligned relative to the carrier plate 46, a curved guide plate 68 and cylindrical guides 72 and 74 are mounted on the carrier plate. The guides 72 and 74 are adjustable through tilt mechanisms 76 and 78 to urge the ribbon toward or away from the carrier plate as necessary.

Figure 2:
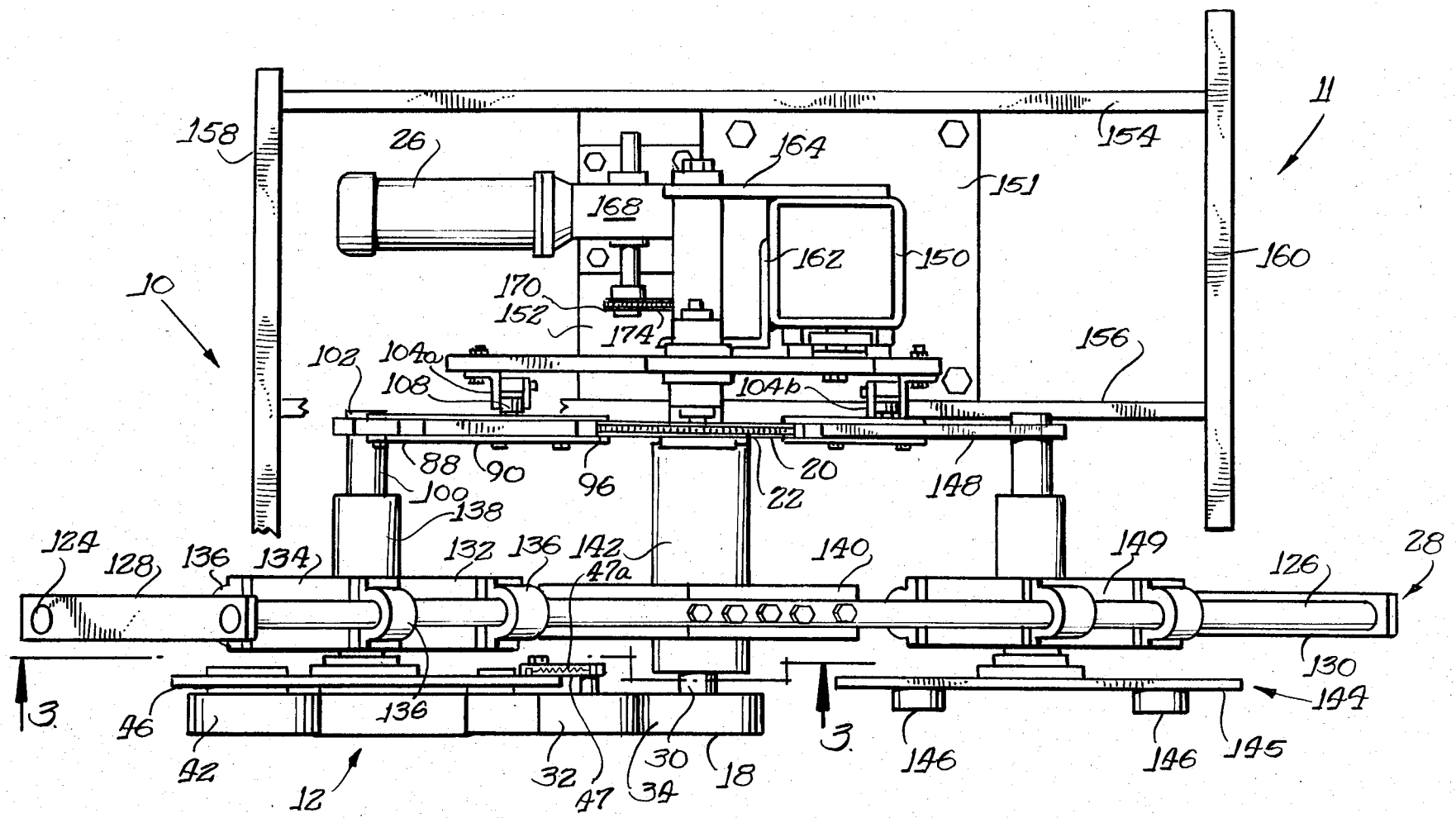
FIG. 2 is a fragmentary plan view of the winding machine of FIG. 1 shown on an enlarged scale with portions broken away for clarity.
Figure 3:
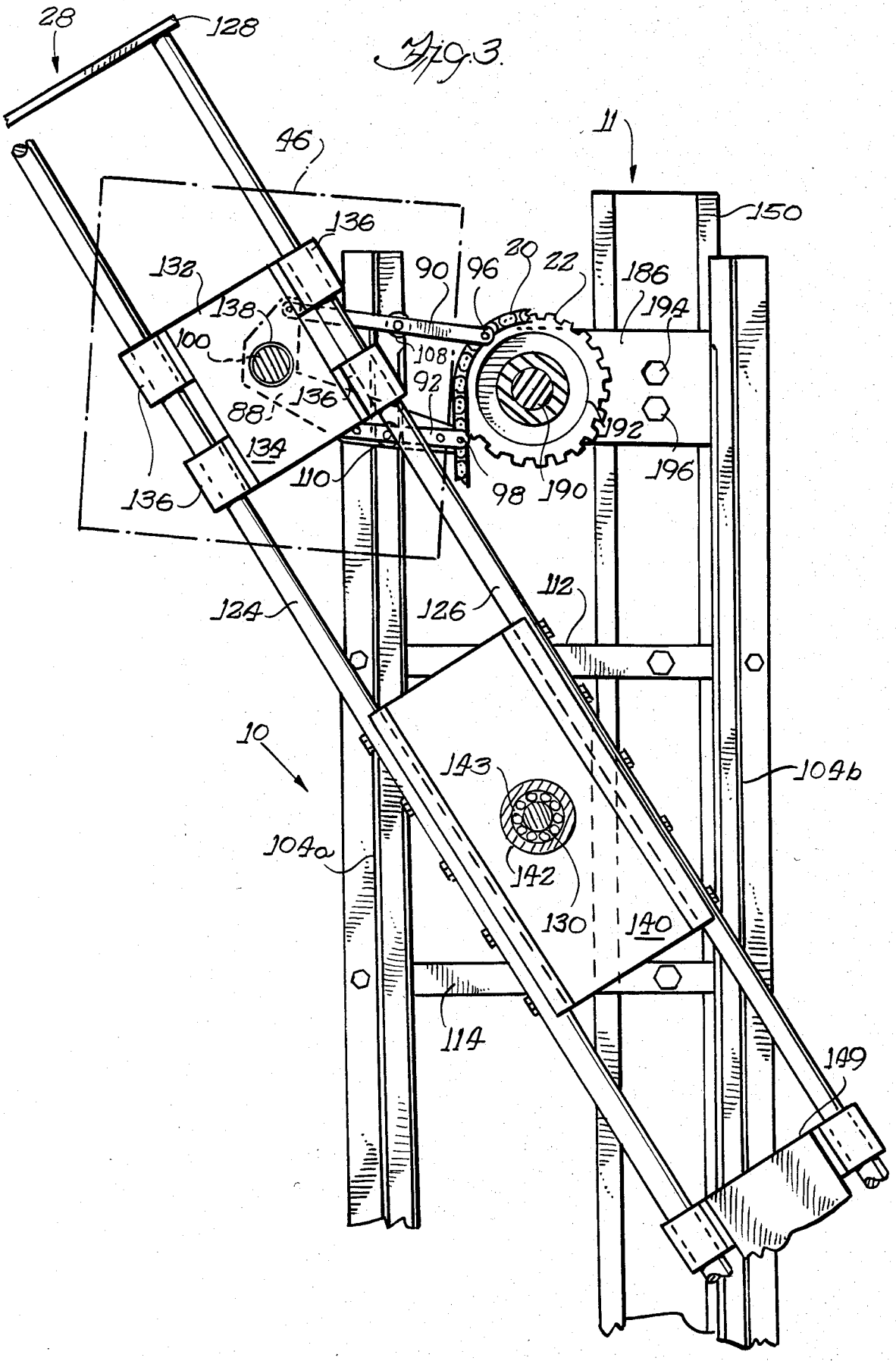
FIG. 3 is a fragmentary vertical sectional view of the winding machine of FIG. 1, taken substantially along line 3—3 of FIG. 2 and looking in the direction of the arrows.

Referring now to FIGS. 2 and 3, the ribbon dispensing assembly 12 is connected to the roller chain by a generally L-shaped chain follower 88. As illustrated in FIG. 3, the chain follower 88 has a pivot arm 90 and a fixed arm 92 thereon (FIG. 3) which are fastened to the chain by pins 96 and 98. The chain follower 88 is rigidly connected to the carrier plate 46 by a horizontal shaft 100 which has its rear end 102 (FIG. 2) fixed to the chain follower and has its forward end fixed to the carrier plate 46 as through screws 103 (FIG. 1).

As the ribbon dispensing assembly 12 travels through its path about mandrel 14, it is desirable to maintain a substantially constant spacing between the dispensing assembly and the mandrel 14 so that the winding apparatus will run smoothly and the ribbons will be pulled from the spools 42 and 44 at a relatively uniform rate. At the ends of the path where the chain 20 is supported by the sprockets 22 and 24, the tension on the chain prevents movement of the dispensing assembly 12 away from the mandrel 14, and the sprockets themselves prevent movement toward the mandrel. Along the generally straight vertical portions or runs of the path, the spacing between the dispensing assembly 12 and the mandrel 14 is controlled by a pair of similar elongated vertical guide channels 104*a* and 104*b* which are adapted to receive and guide cam followers 108 and 110 rotatably mounted on the arms 90 and 92 of the chain follower 88. The channels 104*a* and 104*b* are symmetrically positioned on opposite sides of the mandrel 14 and are supported by horizontal support members 112 and 114 (FIG. 1) fixed transversely to the frame 36. As the dispensing assembly 12 travels down the left side of the mandrel, as viewed in FIG. 3, the cam followers 108 and 110 enter the guide channel 104*a* and are guided therealong so as to maintain the carrier plate 46 and roller 32 in predetermined relation to the mandrel. Each channel preferably has tapered entry and exit ends to facilitate smooth entry and exit of the cam followers.

Referring now to the counterbalanced rotating track 28 illustrated in FIGS. 1, 2 and 3, the track includes two elongated metal rods 124 and 126 which are bolted to a rectangular hub 140 and spaced from one another at their ends by transverse braces 128 and 130. The track 28 is connected to the ribbon dispensing assembly 12 by a slider 132 which is free to rotate with respect to the dispensing assembly. As best viewed in FIG. 3, the slider 132 spans the width of the track 28 and includes a centrally-perforated, generally rectangular body 134 with sleeves 136 positioned at its four corners to slidingly receive the rails. Extending horizontally through the center of the slider 132 is a hollow cylindrical shaft 138 which is rotatably and coaxially mounted upon the shaft 100 which connects the chain follower 88 to the carrier plate 46. A precise sliding fit is maintained between the sleeves 136 and the rods 124 and 126 to provide precise repetition of each cycle by the dispensing assembly 12 as it traverses its path of travel.

As best seen in FIG. 2, the rectangular hub 140 of the track 28 is centrally perforated and fixed to a hollow cylindrical shaft 142 which is rotatably and coaxially mounted on the horizontal support 30 through an annular bearing 143 (FIG. 3).

To balance the track 28 as the ribbon dispensing assembly 12 traverses its cyclic path about the mandrel, a counterweight 144 travels through the same path 180° out of phase with the assembly 12. The counterweight 144 includes a carrier plate 145 similar to the carrier plate 46 of the ribbon dispensing assembly and has suitable weights 146 carried thereon to approximate the mass of the roller 32, spools 42 and 44, and other elements which are carried by the carrier plate 46 of the ribbon dispensing assembly 12. As best viewed in FIG. 2, the counterweight 144 includes a chain follower 148 and a slider 149 identical to those of the ribbon dispensing assembly 12.

The frame 11 which supports the various components of the apparatus includes a column 150 extending vertically upwardly from a base plate 151 which is bolted to a horizontal platform 152 supported by two parallel horizontal support beams 154 and 156. Two additional horizontal beams 158 and 160 are fixed to opposite ends of the support beams 154 and 156 to add stability to the structure. The cylindrical horizontal support 30 is rigidly upheld by an angle 162 and a plate 164 which are welded to the column 148 and the horizontal support 140. The horizontal support 30 passes through circular bores in the angle 162 and plate 164.

Figure 4:
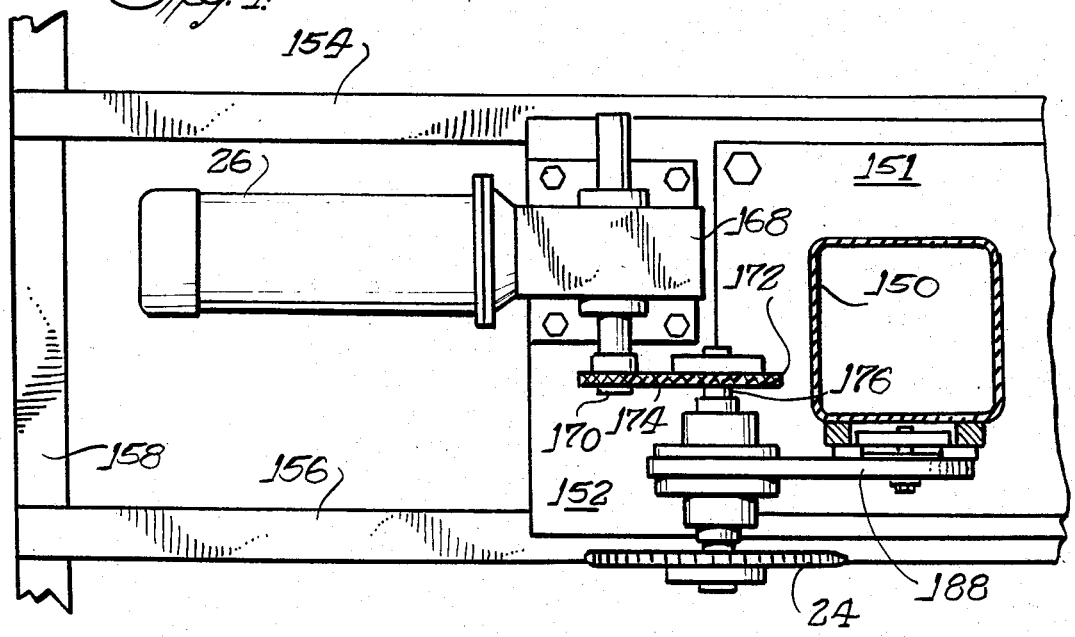
FIG. 4 is a fragmentary transverse sectional view taken substantially along line 4—4 FIG. 1 and looking in the direction of the arrows.

As aforementioned, the roller chain 20 which transports the ribbon dispensing assembly 12 through its path about the mandrel 14 is driven by the motor 26. Referring to FIGS. 1 and 4, the motor 26 is mounted on and operatively associated with a gearbox 168 having an output drive sprocket 170 which is connected to a driven sprocket 172 by a drive chain 174. The driven sprocket 172 is fixed to a shaft 176 (FIG. 4) upon which the lower sprocket 24 for the roller chain is also fixed. As best viewed in FIG. 1, an adjustable idler sprocket 178 engages the drive chain 174 and is rotatably mounted at the end of a pivot arm 180 which may be adjusted to take up slack in the drive chain. The position of the arm 180 may be adjusted by turning a threaded bolt 182 which has one end set against the column 148 and which extends through a threaded nut 184 welded to the arm 180. Rotation of the bolt 182 displaces the nut 184 in the direction of the axis of the bolt and forces the arm 180 to pivot, thus tightening or loosening the drive chain 174.

Figure 5:
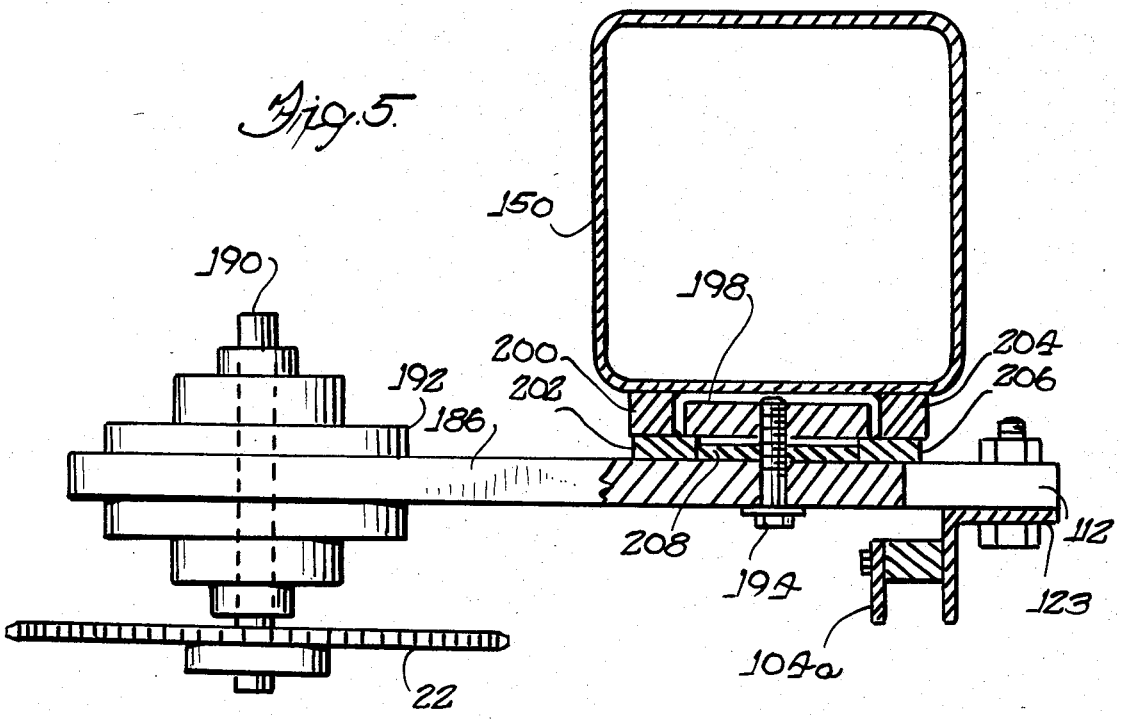
FIG. 5 is a fragmentary transverse sectional view taken substantially along line 5—5 of FIG. 1 and looking in the direction of the arrows.

To enable the winding machine to be readily adjusted for use with mandrels of various lengths, the upper and lower roller chain sprockets 22 and 24 are mounted on vertically adjustable support plates 186 and 188 which may be raised or lowered as desired. As best viewed in FIGS. 3 and 5, the upper sprocket 22 is fixed to a horizontal support shaft 190 which is journaled within a bearing 192 mounted on the support plate 186 which is secured to the column 150 by bolts 194 and 196 (FIG. 3) which engage a nut 198 (FIG. 5) having two vertically aligned threaded apertures. The nut is received in a vertical slot formed by rectangular bars 200, 202, 204, and 206 (FIG. 5) welded to the front of the column 148. A guide plate 208 with vertically aligned holes for the bolts fits between two of the bars 202 and 206 to restrict lateral movement of the support plate 186. The height of the sprocket 22 can be adjusted by loosening the bolts 194 and 196 and sliding the support plate vertically to the desired position.

A similar adjustable structure supports the lower sprocket 24 upon its associated shaft 176. The chains 20 and 174 may be altered in length to compensate for vertical adjustments of the sprockets simply by removing or adding links.

From the foregoing it may be seen that the present invention provides a novel winding apparatus for winding successive layers of ribbon upon a fixed mandrel to produce a wound core. In operation, free ends of two ribbons 48 and 50 supported on spools 48 and 50 carried by the ribbon dispensing assmbly 12 are fastened to the mandrel, and the ribbon dispensing assembly 12 is caused to travel about the mandrel, continuously depositing ribbon thereupon until the winding is built up to the desired thickness. The pressure roller 32 continuously presses each successive layer of ribbon onto the underlying layer and eliminates air from between the successive wound layers. After the winding has been completed the core is removed from the mandrel.

The embodiment of the present invention illustrated in the attached drawings is configured specifically for use with an elongated "racetrack" shaped mandrel. The present invention may also be adapted for use with mandrels of various other shapes by selective positioning of chain guide sprockets as necessary to define a desired path for the ribbon dispensing assembly. When employing a mandrel having a configuration different from mandrel 16, guide channels similar to guide channels **104*a* and 104*b*** are preferably provided at least along and parallel to straight or planar surface portions of the selected mandrel.

While a preferred embodiment of the present invention has been illustrated and described, it will be understood that the invention may be embodied in various forms, and this disclosure should not be construed to limit the scope of the invention in any way.

What is claimed is:

1. Winding apparatus for depositing successive layers of ribbon upon a mandrel to form a winding, comprising:

frame means, a mandrel supported by said frame means and having a peripheral support surface, a ribbon dispensing assembly, drive means operatively associated with said frame means and said dispensing assembly to transport said dispensing assembly through a predetermined path about the periphery of said mandrel, and a counterbalanced rotating track which engages said dispensing assembly as it travels through said predetermined path, said dispensing assembly depositing successive layers of ribbon on said peripheral support surface as it travels through said predetermined path, said dispensing assembly including means for applying transverse pressure to an outer exposed surface of the winding as each successive layer of ribbon is applied thereto.

2. Winding apparatus for depositing successive layers of ribbon on a mandrel to form a winding, comprising:

frame means, a mandrel supported by said frame means and having a peripheral support surface, a ribbon dispensing assembly, drive means to transport said dispensing assembly through a predetermined path about the periphery of said mandrel, roller means comprising a roller rotatably mounted upon a pivot arm, said pivot arm being pivotably mounted upon said dispensing assembly and biased to urge said roller toward said winding, said roller being positioned to roll over the peripheral surface of the winding as said dispensing assembly travels through said predetermined path, and a counterbalanced rotating track which engages said ribbon dispensing assembly as it travels through said predetermined path.

3. Winding apparatus in accordance with claim 2 wherein said drive means comprises a roller chain which is mounted upon two sprockets and a motor to drive the roller chain.

4. Winding apparatus in accordance with claim 3 wherein said dispensing assembly comprises a chain follower to connect said dispensing assembly to said roller chain, a shaft extending transversely away from said chain follower, a carrier plate fixed to said shaft, a slider rotatably mounted on said shaft and slidingly engaging said rotating track, a plurality of ribbon supply spools mounted on said carrier plate, and ribbon guide means mounted on said carrier plate.

* * * * *